US008406085B2

(12) United States Patent
Sakita

(10) Patent No.: US 8,406,085 B2
(45) Date of Patent: Mar. 26, 2013

(54) SWIM DEVICE

(76) Inventor: Masami Sakita, San Francisco, CA (US)

( * ) Notice: Subject to any disclaimer, the term of this patent is extended or adjusted under 35 U.S.C. 154(b) by 580 days.

(21) Appl. No.: 12/653,880

(22) Filed: Dec. 21, 2009

(65) Prior Publication Data

US 2011/0149694 A1 Jun. 23, 2011

(51) Int. Cl.

| | |
|---|---|
| ***G04B 47/00*** | (2006.01) |
| ***G04F 8/00*** | (2006.01) |
| ***A63B 69/00*** | (2006.01) |
| ***A63B 71/00*** | (2006.01) |
| ***A63B 31/00*** | (2006.01) |

(52) U.S. Cl. ..... 368/10; 368/110; 340/323 R; 482/8; 482/55

(58) Field of Classification Search ..... 368/10, 368/11, 107–109, 110, 113; 434/254; 482/55; 484/3, 8; 340/323 R See application file for complete search history.

(56) References Cited

U.S. PATENT DOCUMENTS

| | | | | |
|---|---|---|---|---|
| 4,651,120 | A | 3/1987 | Aagard | |
| 4,652,141 | A * | 3/1987 | Arai | 368/278 |
| 4,866,412 | A | 9/1989 | Rzepczynski | |
| 4,932,045 | A | 6/1990 | Kasoff et al. | |
| 5,124,960 | A * | 6/1992 | Miller et al. | 368/278 |
| 5,734,625 | A * | 3/1998 | Kondo | 368/10 |
| 5,766,131 | A * | 6/1998 | Kondo et al. | 600/502 |
| 5,767,417 | A * | 6/1998 | Parris et al. | 73/861 |
| 5,812,049 | A * | 9/1998 | Uzi | 340/323 R |
| 5,864,518 | A * | 1/1999 | Geiser | 368/10 |
| 5,871,406 | A * | 2/1999 | Worrell | 473/221 |
| 6,144,620 | A * | 11/2000 | dePoortere | 368/108 |
| 6,241,684 | B1 * | 6/2001 | Amano et al. | 600/531 |
| 6,543,299 | B2 | 4/2003 | Taylor | |
| 6,870,466 | B2 * | 3/2005 | Rust et al. | 340/323 R |
| 7,345,958 | B1 | 3/2008 | Kneafsey | |
| 7,641,590 | B2 * | 1/2010 | Chan | 482/3 |
| 2010/0059561 | A1 * | 3/2010 | Ellis et al. | 224/267 |
| 2010/0210975 | A1 * | 8/2010 | Anthony et al. | 600/595 |
| 2010/0304934 | A1 * | 12/2010 | Woodson | 482/8 |
| 2011/0128824 | A1 * | 6/2011 | Downey et al. | 368/14 |

OTHER PUBLICATIONS

Timex Datalink, Wikipedia, Jun. 13, 2010, http://en.wikipedia.org/wiki/Timex_Datalink#cite_note-Timex_Corp._History-1.

Timex Ironman, Wikipedia, Jun. 13, 2010, http://en.wikipedia.org/wiki/Timex_Ironman.

* cited by examiner

*Primary Examiner* — Vit W Miska

(57) ABSTRACT

The swim device includes a wrist unit system wearable on a wrist and a hand, at least one hand sensor unit that is wearable on a hand, and at least one foot sensor unit wearable on a foot. The wrist unit system includes a wrist unit and at least one pressure sensor. The wrist unit includes an integrated circuit chip (ICC) computer; a battery; an alarm, a display and housing with input buttons, and a wrist band with an embedded antenna. The hand/foot sensor unit includes an integrated circuit chip (ICC) computer with a battery. The pressure sensor is attached to a cap that is worn on the first segment of a finger or big toe in such a manner that the pressure sensor faces the water-bound side of the finger or big toe.

4 Claims, 14 Drawing Sheets

SWIM DEVICE

FIELD OF THE INVENTION

This invention relates generally to a device used by the swimmer to measure elapsed time of a swim, count the number of laps, and analyze the swim.

BACKGROUND OF THE INVENTION

Available information on the Internet indicates that there are 300,000 competitive swimmers of all age groups and another 40,000 well trained swimmers who swim regularly in the United States. These numbers probably imply that there are roughly one million competitive and/or well trained swimmers in the world, and the number is probably growing rapidly as the income level of people in some of large developing nations is rising rapidly. One swim device that is probably sought by these swimmers and possibly many more millions of regular recreational swimmers is a wearable device that is capable of measuring elapsed time accurately, counting the number of laps in a swim automatically, and making alarm sounds while the swimmer is swimming the last lap or length.

Two types of swim devices are available in the market for the individual swimmer in measuring elapsed time and counting the number of laps: one is a touch panel that is attached to end walls of a lane and is pressed by the swimmer when he/she reaches an end wall, and the other is a chronograph that is worn on a wrist of the swimmer and its start/finish button is pressed by the swimmer. Each type has a different problem: the former may not work well when a plurality of swimmers share the same lane, and the latter will not be able to measure the elapsed time accurately especially in short distance swims.

The swim device described in this invention is aimed to solve those problems in the available swim devices. The basic approach of the invention is to use pressure sensors worn by a swimmer on at least one hand and at least on one foot, and clock key time points such as the start, turns and the finish in a swim. Each of these sensors is connected by wires to a wearable integrated circuit chip (ICC) computer equipped with an internal clock. One of the ICC computers is housed in a chronograph like housing equipped with a display unit and a whistle-sounding alarm for signaling starting and last lap or last length, and worn on a wrist (a wrist unit) in which the ICC computer analyzes sensor data on-line real time and determines whether a turning is made after every turn. The data collected by the other touch pressure sensors worn on other hand and feet and stored in the ICC computers are transferred to the wrist unit via contactless communications and automatically combined together immediately after the swim, and the results are shown on the display of the wrist unit. A serious competitor who requires accurate measurements of elapsed time and splits in a swim could use a fully equipped system, and a recreational swimmer who does not need splits or accurate total elapsed time could use only a wrist unit to which a sensor (or sensors) is/are connected.

OBJECTS OF THE INVENTION

An object of this invention is the provision of a wearable swim device that is able to measure elapsed time of not only the total distance but also splits of a swim; is able to make sounds at the last lap or last length of the swim; and is able to count the number of laps the swimmer swam automatically in any of the existing swim stroke types including individual medley.

An object of this invention is the provision of a swim device that is able to fulfill the aforementioned object even when a plurality of swimmers all of who may or may not use the same device share the same lane.

An object of this invention is the provision of a swim device that is able to fulfill the first aforementioned object even when a plurality of swimmers of a same team wearing this swim device swim a medley.

SUMMARY OF THE INVENTION

The preferred embodiment of a swim device includes a wearable wrist unit system equipped with a couple of sensors, a hand sensor unit that is wearable on a hand, and at least one foot sensor unit that is wearable on a foot.

The wrist unit includes at least one integrated circuit chip (ICC) computer that includes a CPU, RAM, ROM, EPROM, EEPROM and input/output interface; a couple of pressure sensors attached to finger caps or equivalent, a battery; an alarm with whistle-like sounds produced at the start of a swim and during the last lap or the last length of the swim while the swimmer's wrist unit wearing hand is in the air; a display means and housing equipped with push buttons; and a wrist band with an embedded antenna. The wrist unit receives input data manually from the user, transmits an activation pulse and receives pressure data to/from the hand and foot sensor units via contactless radio frequency communications, processes data generated by the hand and foot sensor units, and displays the input data and processed data.

The hand sensor unit includes at least one integrated circuit chip (ICC) computer that includes a CPU, RAM, ROM, EPROM, EEPROM and input/output interface; an antenna used for contactless radio frequency interface; at least one pressure sensor that detects pressure applied to the sensor surface; and a battery. The pressure sensor is attached to an elastic finger cap or equivalent (an elastic band having a fastener at each of the two ends and straps around the tip segment) of a finger in such a manner that the pressure sensor faces the inner side of the finger. The foot sensor unit is identical to the hand sensor unit except that the cap or equivalent to which the pressure sensor is affixed is worn on a big toe.

The swim device also includes an interface that is used in data transfer between a computer (PC or equivalent) and the three wearable units; i.e., the hand sensor unit, the foot sensor unit, and the wrist unit, and software run on the computer.

BRIEF DESCRIPTION OF THE DRAWINGS

The above description and other objects and advantages of this invention will become more clearly understood from the following description when considered with the accompanying drawings. It should be understood that the drawings are for purposes of illustration only and not by way of limitation of the invention. In the drawings, like reference characters refer to the same parts in the several views.

DETAILED DESCRIPTION OF THE INVENTION

Figure 1:
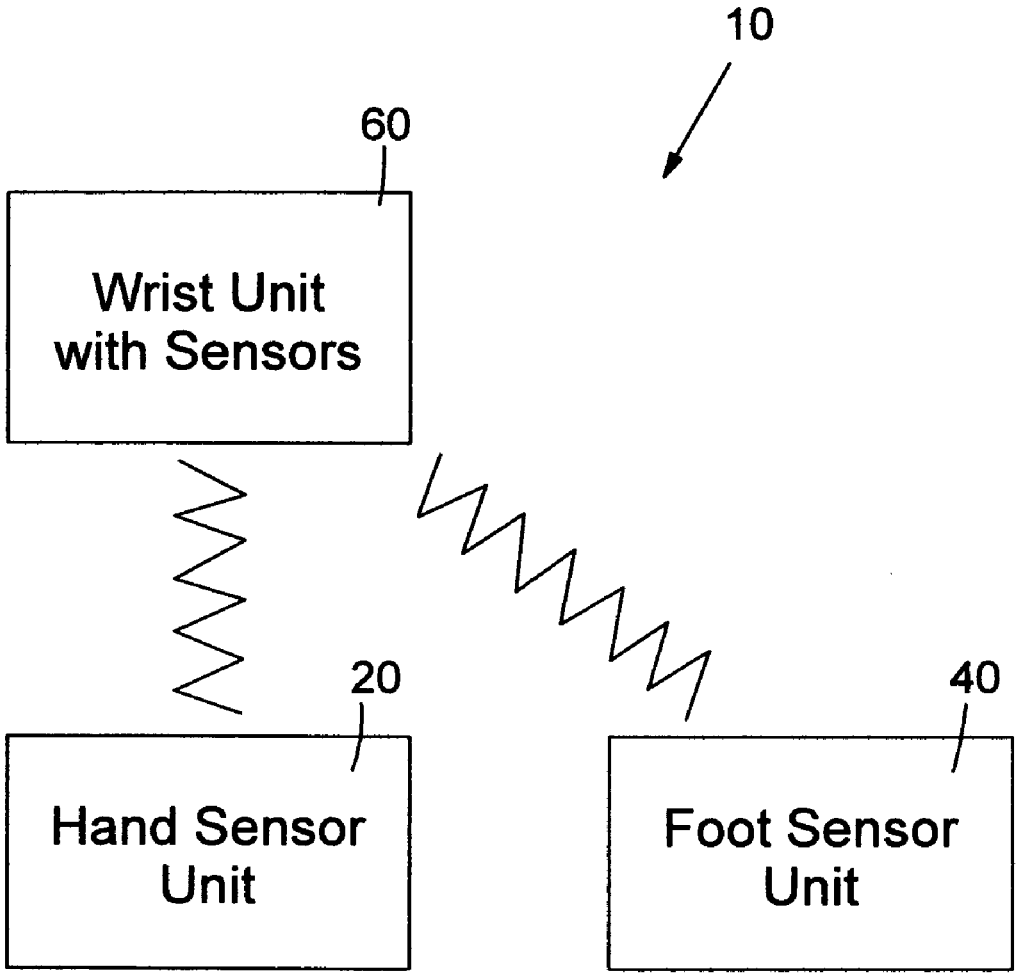
FIG. 1 is a schematic representation of the preferred embodiment of the present invention.

The preferred embodiment of a wearable (and thus waterproof or water resistance) swim device 10 worn by a swimmer includes a wrist unit system 60 that includes a wrist unit 18 wearable on a wrist and a couple of sensors wearable on the hand on the same side of the body, one hand sensor unit 20 wearable on the hand on the other side of the body, and at least one foot sensor unit 40 that is wearable on a foot. The wrist unit 18, the hand sensor unit 20 and the foot sensor unit 40 are equipped with a contactless communication means, and the wrist unit 18 is able to communicate wirelessly with the hand sensor unit 20 and the foot sensor unit 40 before and after the swim.

The wrist unit system 60 (see FIGS. 2, 6A, 6B, 7A, and 7B) includes a wrist unit 18 and a couple of touch pressure sensors 14 and 9. The wrist unit 18 includes at least one embedded integrated circuit chip (ICC) computer 19 that includes a CPU, RAM, ROM, EPROM, EEPROM and input/output interface; software in the EPROM that processes input signal from the touch pressure sensors 14 and 9; a battery 17; an alarm with whistle-like sound that produces sound at the start of a swim and during the last lap or the last length of the swim while the swimmer's wrist unit wearing hand is iri the air; and a wrist band 16 with an embedded antenna 13 for contactless radio frequency communications. The integrated circuit chip computer 19 has an internal clock. The wrist unit 18 transmits and receives on-line real time input signals to and from the touch pressure sensors 9 and 14 via wires, and processes the input signals on-line real time.

The touch pressure sensor 14 is attached to the surface of a cap 12 that is worn on the first segment of a finger, or attached to a band that straps around the first segment of the finger, and connected to the single chip computer 18 by wires; a touch pressure sensor 9 is attached to the surface of another cap 8 or equivalent that is worn on the first segment of another finger, and connected to the single chip computer 18 by wires.

The wrist unit receives swim related input data off-line from the user manually and/or wirelessly via a PC or equivalent; transmits the off-line input data to the hand and foot sensor units and receives the pressure data off-line from the hand and foot sensor units via radio frequency communications; processes the on/off sensor data (see the following paragraph) generated by the hand and foot sensor units; and displays the input data and processed data.

Figure 2:
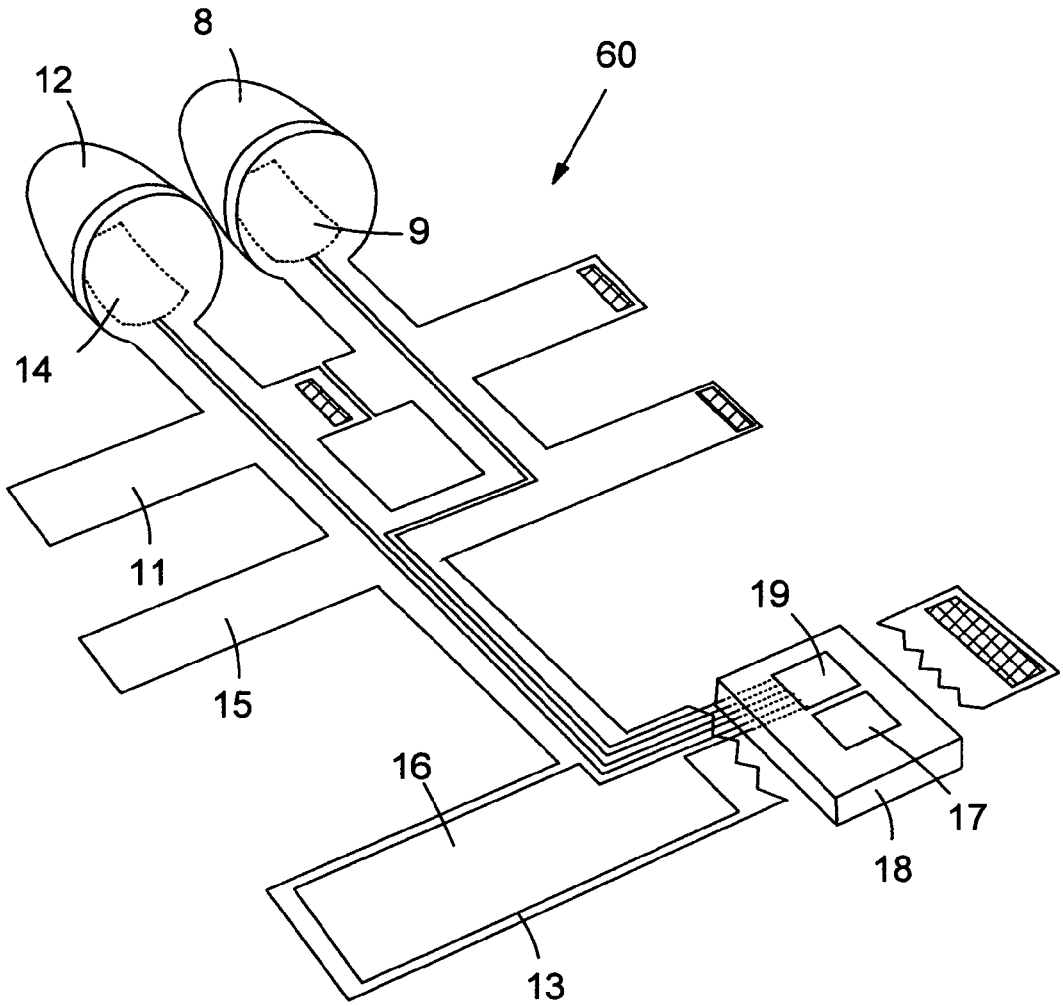
FIG. 2 is a perspective view of a wrist unit system that includes a wrist unit and a couple of touch pressure sensors of the preferred embodiment.
Figure 3A:
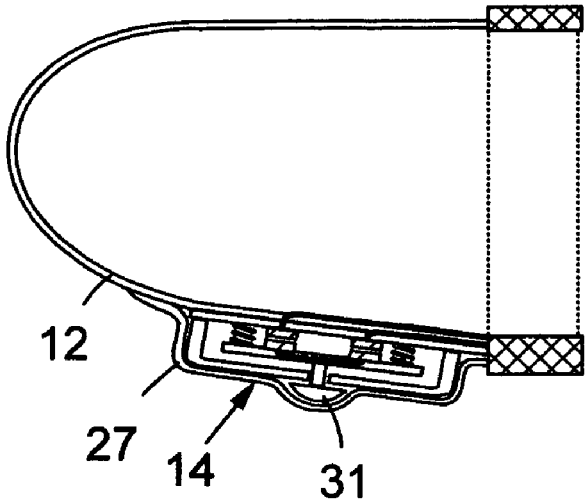
FIG. 3A is a cross-sectional view of a sensor of the preferred embodiment.

The touch pressure sensor shown by reference characters 9 and 14 attached to the caps 12 (and the sensor 24 in the hand sensor unit 20 and the sensor 44 in the foot sensor unit 40) of the preferred embodiment in FIG. 2, and its detail shown in FIG. 3A is enclosed in a space created by an elastic material cover 27 and the cap 12, and its spring loaded pressure sensor button 31 closes an electric circuit and changes the pressure sensor state to the "on" state from the "off" state when the pressure applied to the pressure sensor button 31 exceeds a predefined pressure level. The pressure level that triggers the pressure sensor 14 is adjusted to the level that it is able to detect swimmer's hand touching the pool walls at the finish (and start or turns in some strokes), but is not able to detect swimmer's hand stroking the water. The pressure level of the pressure sensor 9 on the other hand is adjusted to be low enough to detect swimmer's hand stroking the water.

Figure 4:
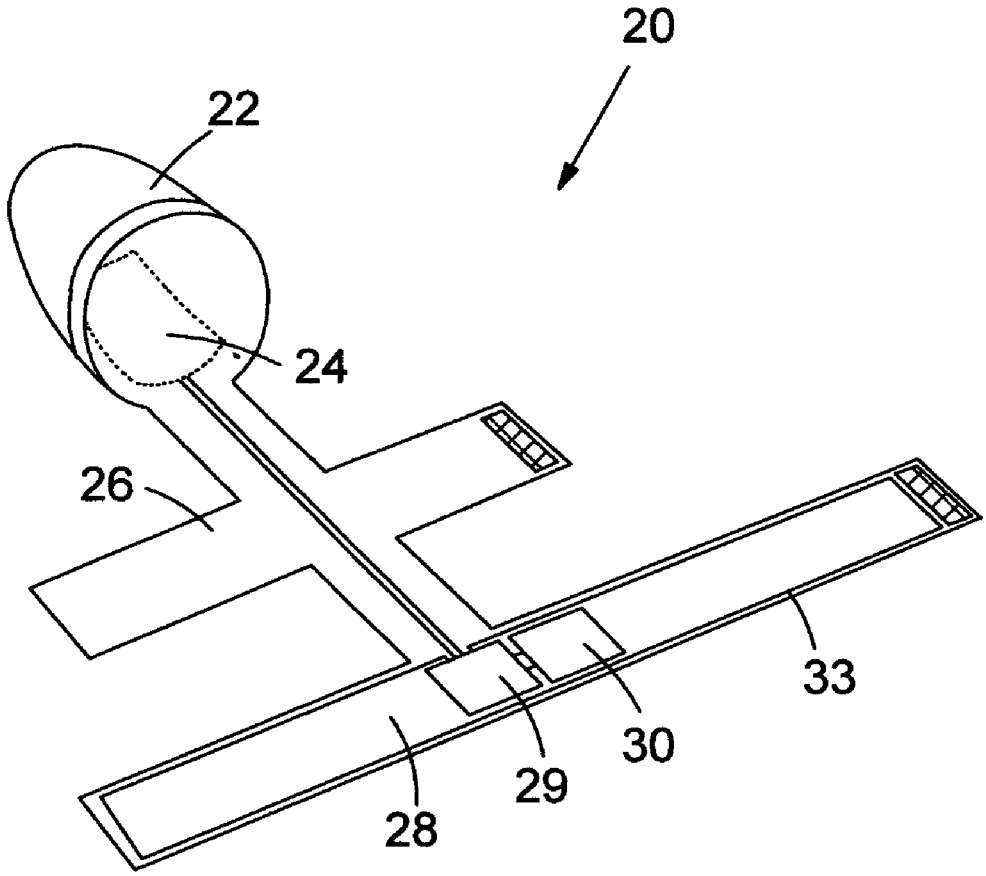
FIG. 4 is a perspective view of a hand sensor unit of the preferred embodiment of the present invention.

As shown in FIG. 4, the hand sensor unit 20 includes at least one integrated circuit chip (ICC) computer 29 that includes a CPU, RAM, ROM, EPROM, EEPROM and input/output interface; an antenna 33 for contactless radio frequency communications; at least one pressure sensor 24 that detects pressure applied to the sensor means; software that processes input signal from the touch pressure sensors; and a battery 30. The pressure sensor 24 is attached to an elastic cap 22 that is put on the first segment of a finger, or attached to a band that straps around the first segment of the finger. The cap 22 (or equivalent) to which the pressure sensor 24 is attached to is connected, by an elastic band, to another elastic band 26 that is strapped around the base segment of the finger, and to another elastic band 28 that encloses the embedded integrated circuit chip computer 29 and the antenna 33, and is strapped around the palm segment of the hand. The integrated circuit chip computer 29 has an internal clock.

Figure 5:
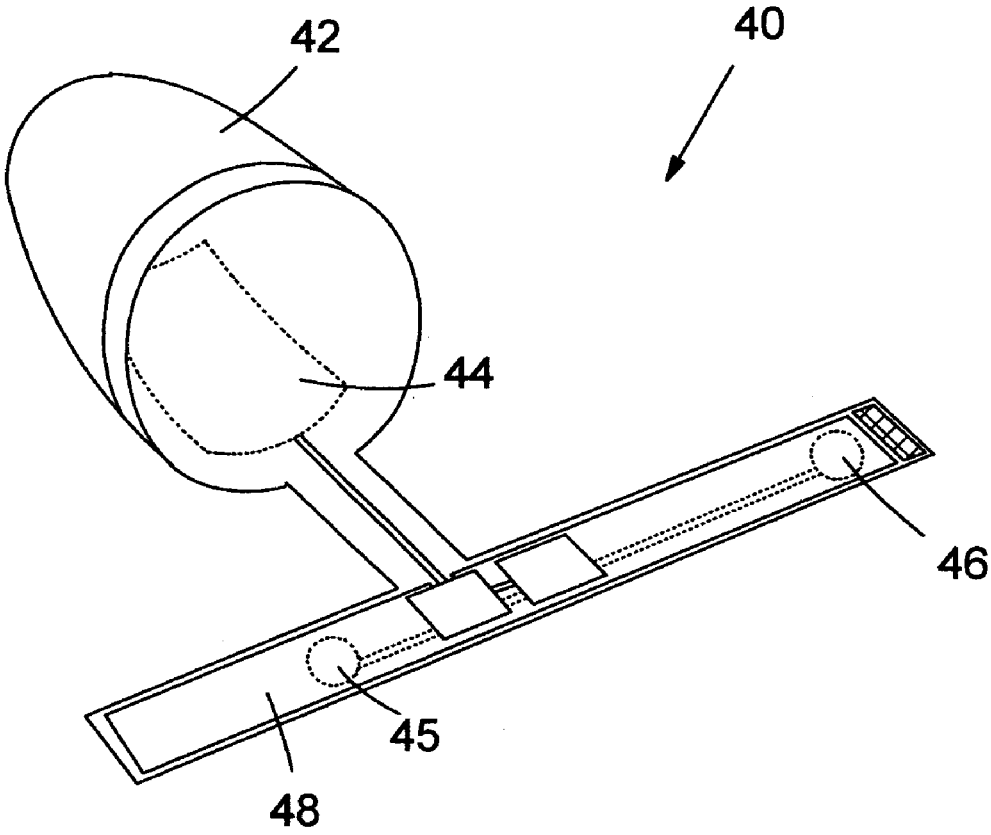
FIG. 5 is a perspective view of a foot sensor unit of the preferred embodiment of the present invention.
Figure 6A:
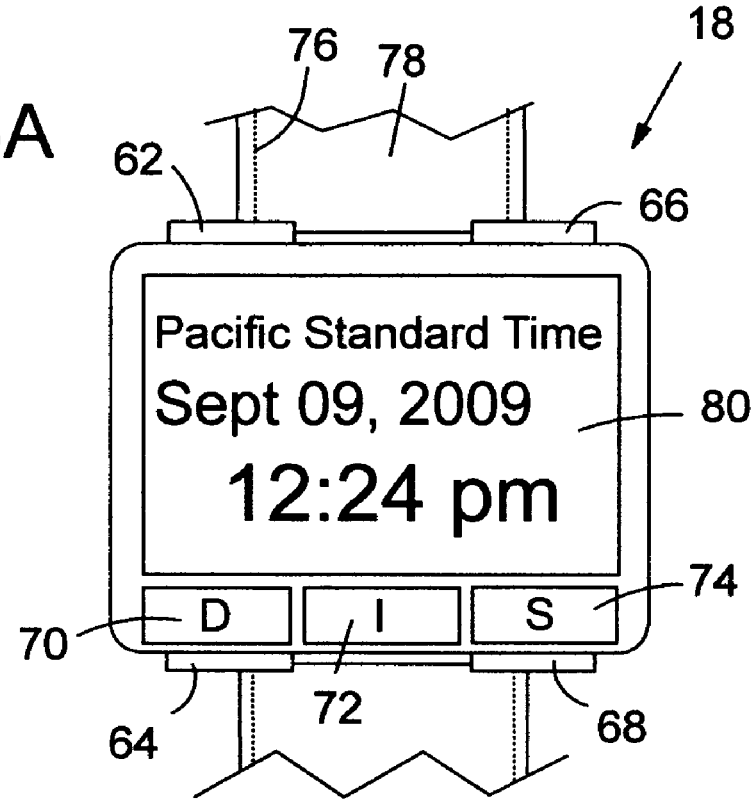
FIG. 6A is a wrist unit of the preferred embodiment of the present invention of which display showing a standard view and FIG. 6B the input view.
Figure 6B:
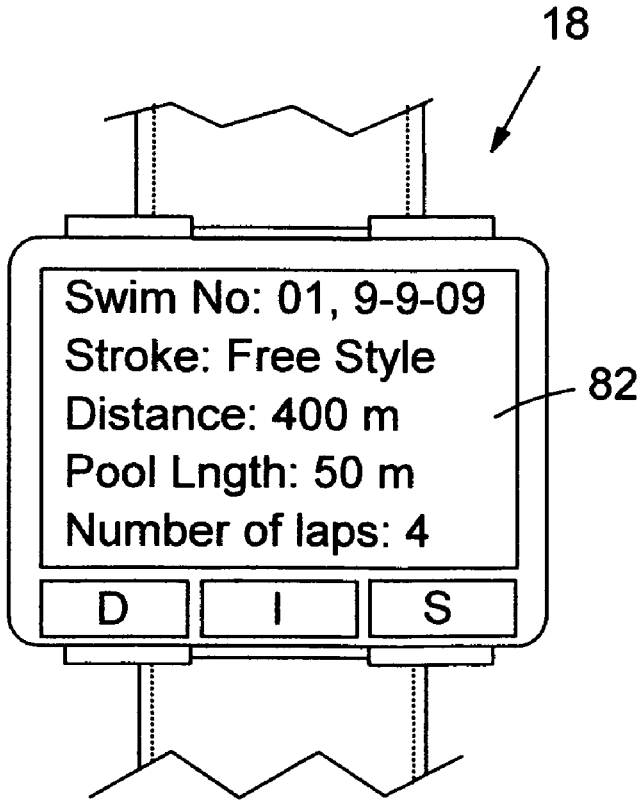

The foot sensor unit 40 shown in FIG. 5 is functionally identical to the hand sensor unit except that a cap 42 (or equivalent) is put on a big toe in such a manner that the pressure sensor 44 faces the inner side of the big toe, and the foot sensor unit includes a pressure-activated on switch 45 for activation and a pressure-activated off switch 46 for deactivation of the foot sensor unit affixed to the elastic band 48 that is strapped around the midfoot.

In FIG. 6, the buttons of the wrist unit includes lock/unlock button 62 (by sliding it to the direction of the arrow mark); sensor activation/deactivation buttons 62 and 64 (press both buttons inward together); a data transmission button to the hand and foot sensor units 66 or to a PC or equivalent 122 (see FIG. 12); a data transmission button from the hand and foot sensor units 68 or from a computer 122; a display selection button 70 that enables selection of a pages that includes input data 82 and output data 84 and 86.

The wrist unit 18 is able to store as much input and output data as its EEPROM in the integrated circuit chip computer allows. While in the input page 82 (see FIG. 6B), which is displayed by pressing the display selection button 70 and input data type button 72 together once, the user is able to input the following data: swim number, the pool length, the swim stroke type, and either the number of laps to swim or the total distance to swim by pressing the input data type selection button 72 (for example, a swim stroke type) from available input data type and then by pressing the input data selection button 68 (for example, free style) from the available input data shown on the display. Though not shown here, the user name may also be inputted to the wrist unit via contactless communications using the computer 122.

Figure 7A:
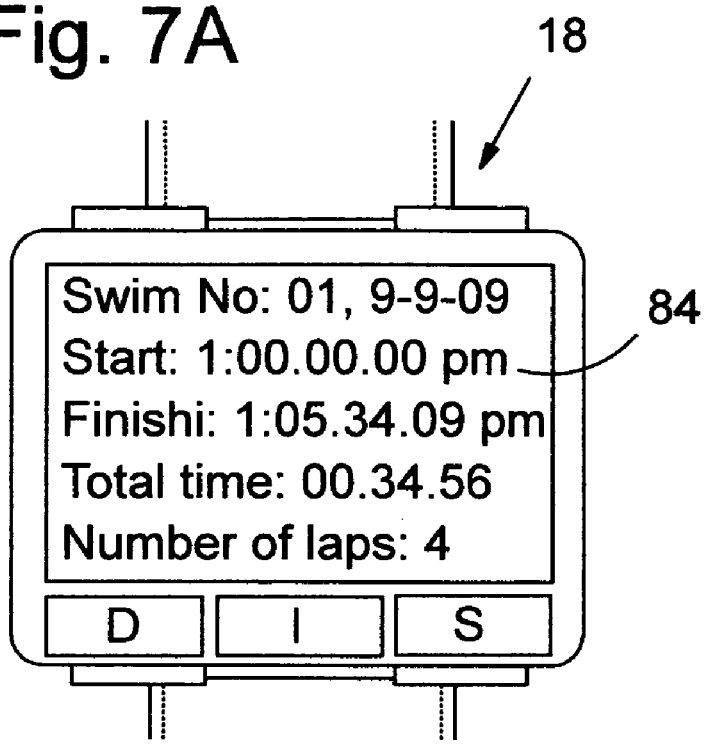
FIGS. 7A through 7B are the first two pages of the output view.
Figure 7B:
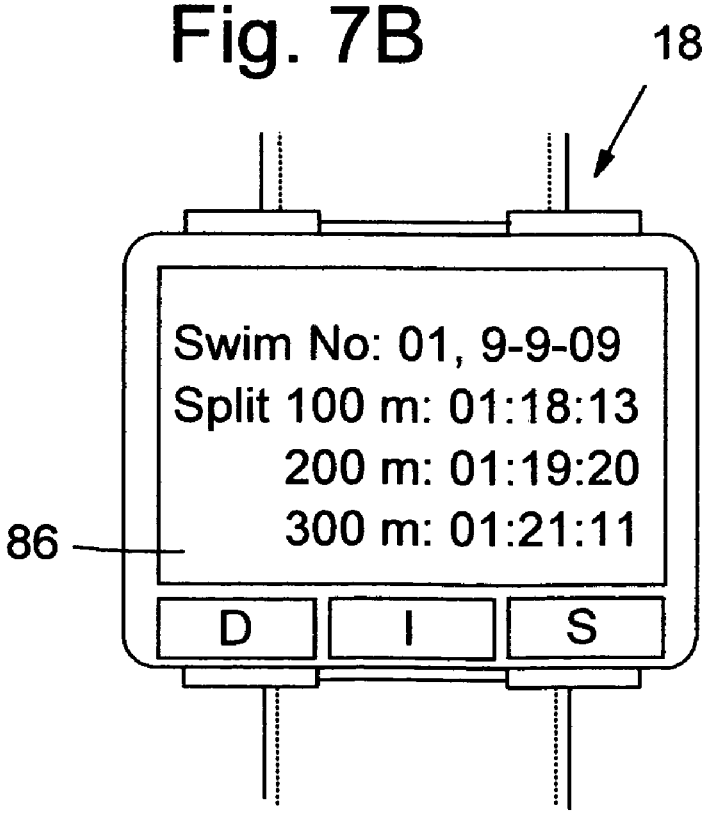

As the input page displaying a specific swim number, pressing of the display selection button 70 once shows the first page 84 of the output data of that swim number as shown in FIG. 7A. Pressing of the display selection button 70 once more shows the second page 86 (see FIG. 7B). Possible split times may be shown spending as many pages as it requires. The output data of the foot sensor unit data can be seen after the swimmer gets out of the pool, or by taking off the foot sensor unit while the swimmer is still in the pool.

Figure 8:
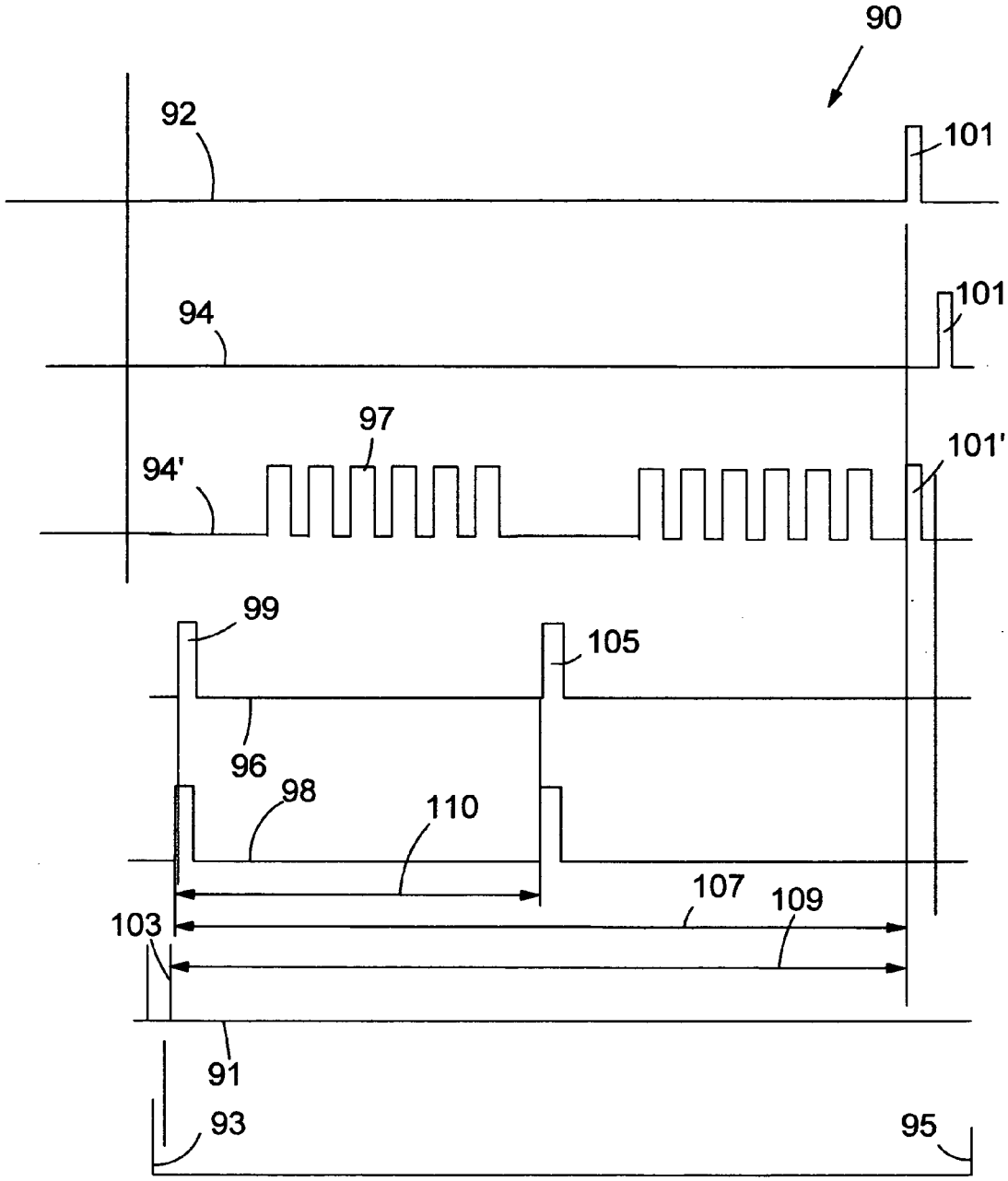
FIG. 8 is a hypothetical conceptual graphics diagram created from the data generated by the wrist, hand and foot sensor units of the preferred embodiment.

FIG. 8 shows a hypothetical collective pressure sensor state diagram 90 of a free style swim that may be possibly constructed from the on/off pressure sensor data generated by the wrist, hand and foot sensor units that use the preferred embodiment of the pressure sensor as shown in FIG. 3A. The diagram 90 includes the state of the pressure sensor 24 of the right hand 92, the state of the pressure sensors 14 and 9 that are connected to the wrist unit 18 (shown in FIG. 8 by 94 and 94') which is assumed to be worn on the left wrist, and the states of the pressure sensor of the right foot 96 and the left foot 98, a diagram 91 that shows the time points at which a preparatory and starting whistles were set off, and a diagram indicating the time point 93 at which the hand, foot and wrist units were activated, and the time point 95 at which at least the hand and wrist units (and possibly all the three units) were deactivated. The y-axis of the top four diagrams show the on/off state of the pressure sensor; the y-axis of the fifth diagram from the top shows the on/off state of the starting whistle, and the x-axis shows time.

It is expected that the pressure applied to the foot pressure sensor will close the circuit at the time point at which the swimmer kicks the pool wall 99 (or the starting stand) at the start. Similarly, it is expected that the pressure applied to the hand pressure sensor and the sensor attached to a finger's cap that is attached to the wrist unit will close the circuit at the time point at which the swimmer touches the pool wall 101 and 101' at the goal. Thus, from these time points that show the earliest "on" time of the starting time pulses 99 and earliest "on" time (or a starting point of the on pulse) of the finishing time pulses 101', it should be possible to measure the time duration 107 it took to swim the defined distance. The split 110 may be measured by measuring the time duration between the start and the turning time, which is recognized by the earliest starting time of a pulse 105 generated by one of the feet. If a starting whistle is used, the time duration 109 between the whistle set off time 103 at the start and the earliest time point of the pressure sensor pulses 101 is the time spent in the swim. The swim time duration without the starting whistle should be shorter than that with the starting whistle.

The touch pressure sensor 9 that is attached to the cap worn on a finger detects the pressure caused by the hand and the water, and closes the circuit at every stroke and creates pulses 97 in the pressure diagram. The software in the wrist unit analyzes the pattern of the pulses on-line real time, and is able to identify a turn after the swimmer swam with a dolphin stroke for a several seconds.

Figure 3B:
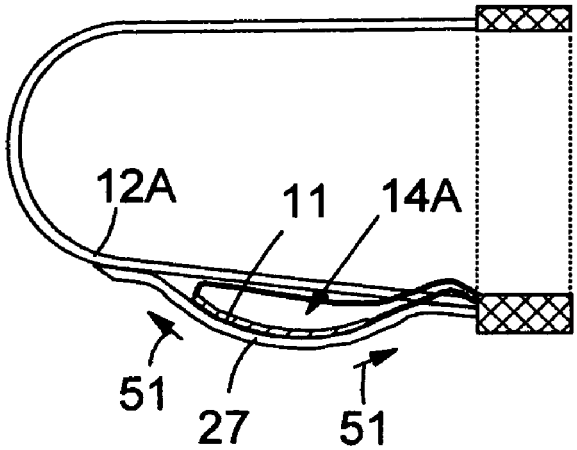
FIGS. 3B and 3C are cross-sectional views of alternative embodiment of the sensor.
Figure 3C:
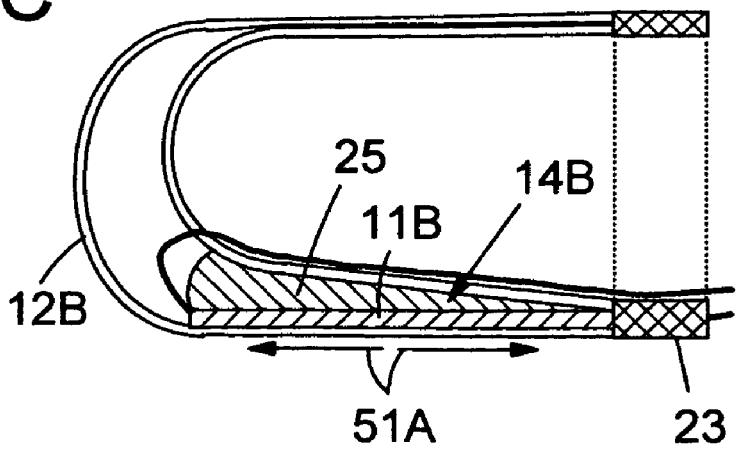
Figure 9:
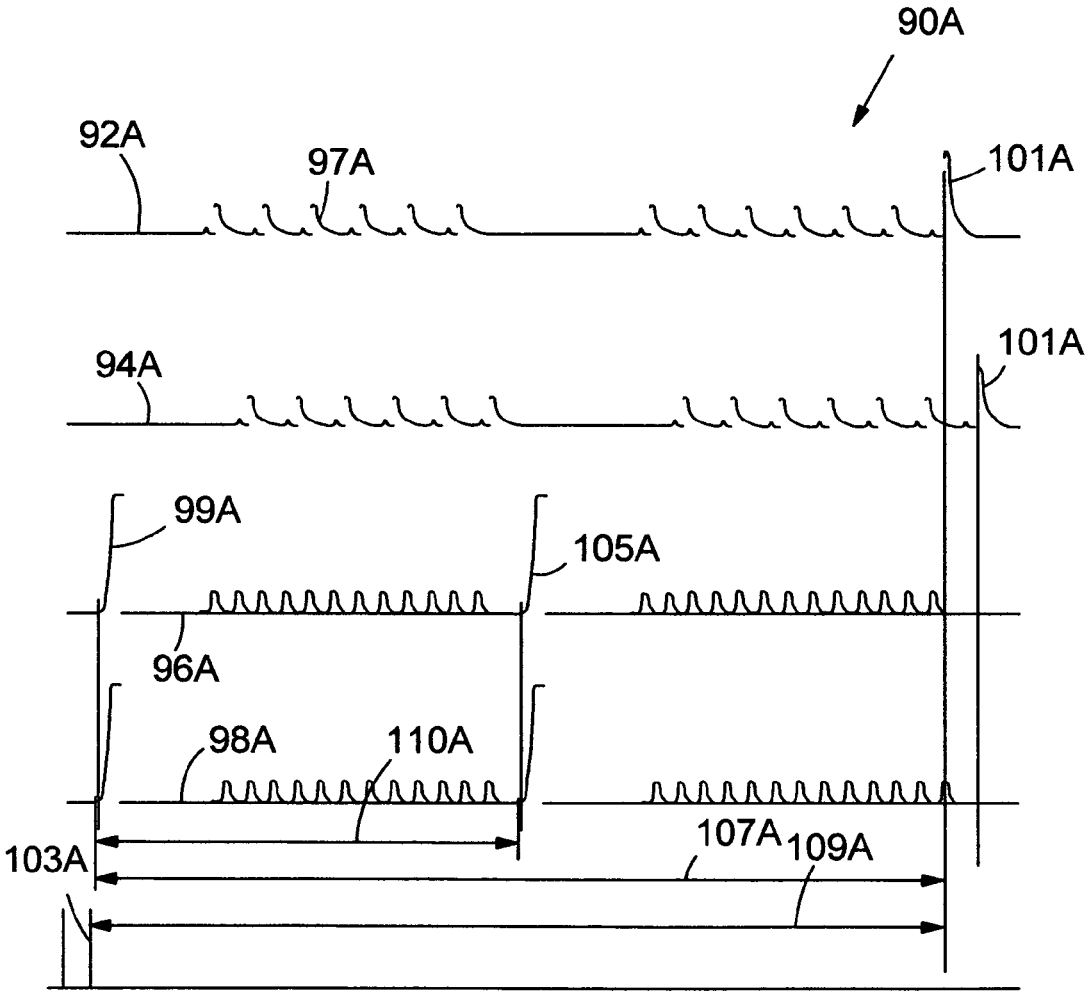
FIG. 9 is a hypothetical conceptual graphics diagram created from the data generated by hand and foot sensor units that use sensors of the alternative embodiments shown in FIGS. 4B and 4C.
Figure 10:
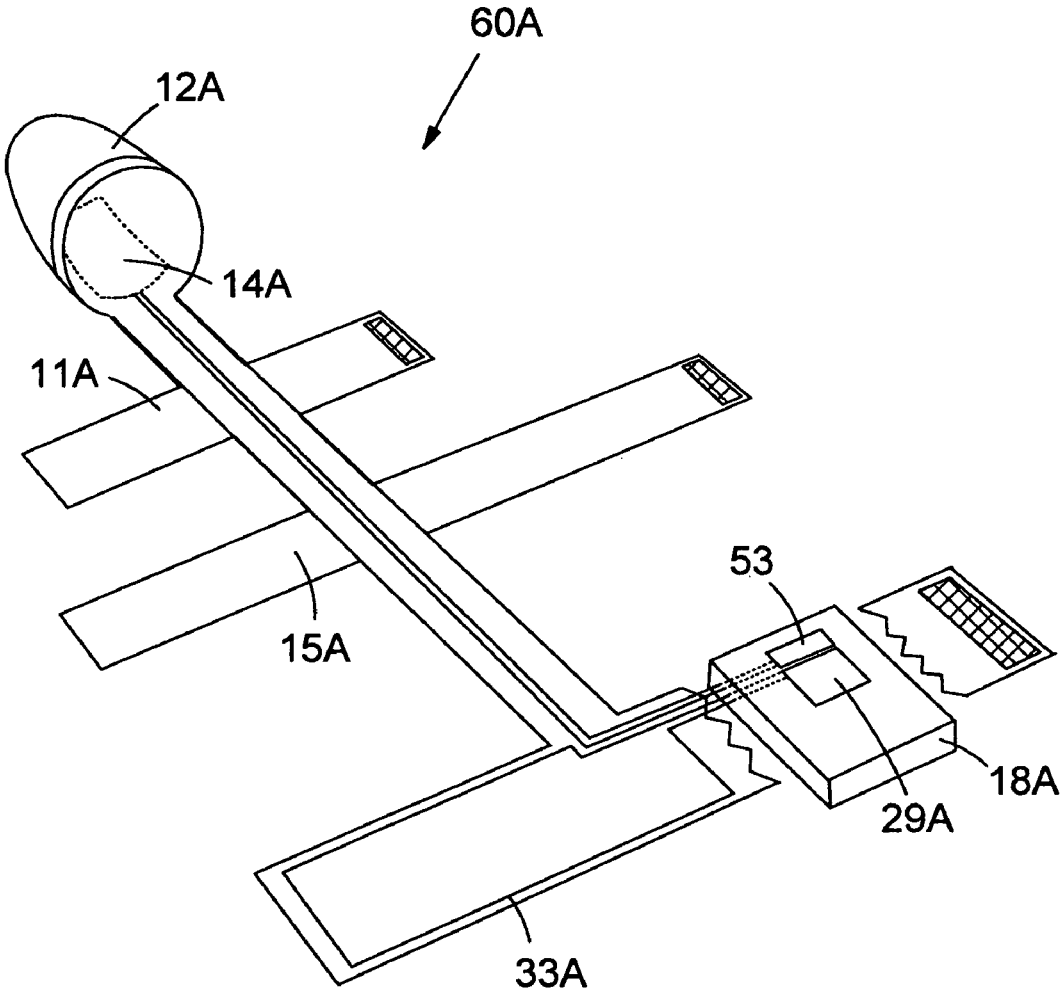
FIG. 10 is an alternative embodiment of the wrist unit system.
Figure 11A:
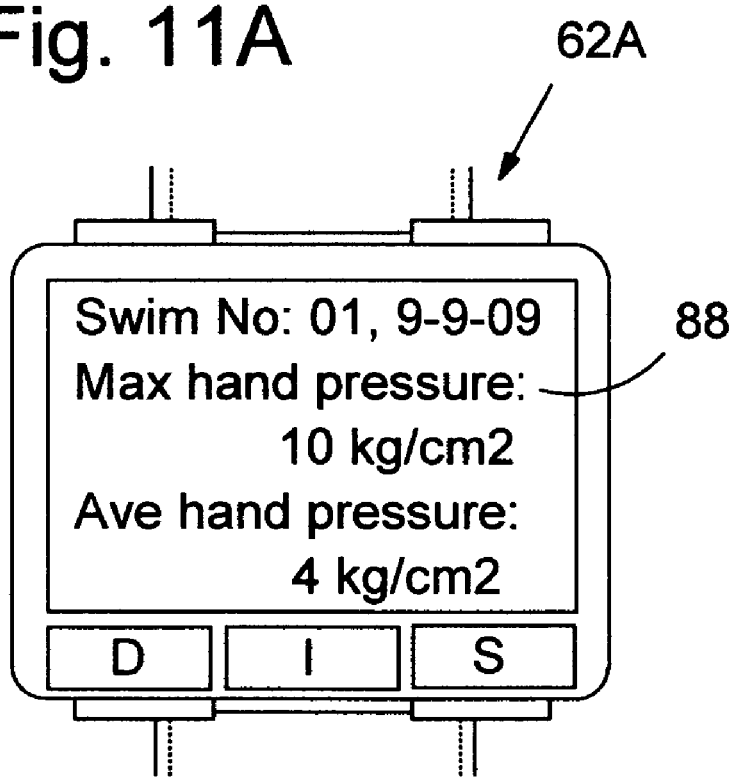
FIGS. 11A through 11B are additional two pages of the output view.
Figure 11B:
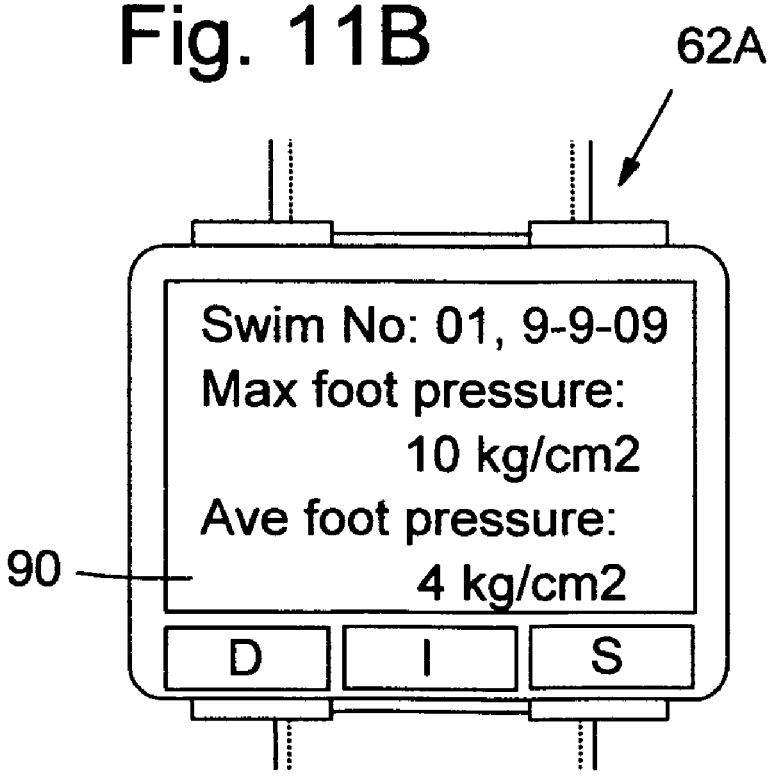

FIG. 9 shows a hypothetical collective pressure diagram 90A for a free style swim that may be possibly constructed from the pressure data generated by the hand and foot sensor units that use the alternative embodiment of the pressure sensor as shown in FIG. 3B or FIG. 3C. In the pressure diagram for the right hand and pressure diagram for the left hand in FIG. 9, the pressure applied to the surface of the pressure sensor of the hand sensor unit varies as the swimmer swims, and creates a unique discontinuous lines 97A wherein the time point at which the discontinuity of the diagram (which may very well be connected by a vertical line in the diagram) is observed is the time point of the hand hitting the water surface. The hand pressure diagram 92A/94A also shows the number of strokes, the time point the swimmer started the strokes in each length of swim. In the pressure diagram for the right foot 96A and left foot 98A, the wavy lines indicate the pressure diagram for the kicks. The y-axis of the top four diagrams show estimated pressure; the y-axis of the fifth diagram from the top shows the on/off state of the starting whistle, and the x-axis shows time.

It is expected that the pressure applied to the foot pressure sensor becomes distinguishably higher at the time point at which the swimmer kicks the pool wall 99A (or the starting stand) at the start or made a turn, and thus the foot pressure sensor should be able to detect the time point at which the swimmer started or made a turn. Similarly, it is expected that the pressure applied to the hand pressure sensor becomes distinguishably higher at the time point at which the swimmer touches the pool wall 101A at the goal, and thus the hand pressure sensor should be able to detect the time point at which the swimmer finished the swim. Thus, from these time points that show the earliest time of the highest pressures at the starting time and earliest time at the finishing times 101A, it should be possible to measure the time duration 107A it took to swim the defined distance, and the split 110A may be measured by timing the duration between the start and the turning times, which is recognized by the high pressure 105A generated by one of the feet or both feet. If a starting whistle is used, measure the time duration 109A between the whistle set off time 103A at the start and the earliest time the pressure of either hand sensor unit starts to increase at the finish.

An alternative embodiment 60A of the wrist unit with a pressure sensor has only one pressure sensor (instead of two) that is able to detect varying pressure as shown in FIG. 9. The pressure sensor 14A is connected to a pressure sensor circuit 53 and to a single chip computer 29A of the wrist unit 18A. The pressure sensor 14A is a type of sensors shown in FIG. 3B or 3C.

Pressure sensors of alternative embodiments shown in FIGS. 3B and 3C are able to detect variations of pressure applied to the sensor surface. The pressure sensors 14A and 14B shown in FIGS. 3B and 3C may be fabricated using a piezoresistive material such as silicon rubber, of which resistance changes as it expands and contracts. In the pressure sensor shown in FIG. 3B, a strip of expandable piezoresistive material is affixed on the inner side of an arch-shaped non-conductive surface of an elastic material cover 27 that is affixed to the cap worn on the first segment of a finger or the big toe. The arch-shaped elastic cover 27 becomes flatter as pressure is applied to its surface, and the piezoresistive material 11 affixed to the internal surface of the cover 27 expands in the directions shown by two arrows 51. In another alternative embodiment of the pressure sensor shown in FIG. 3C, a strip of bendable piezoresistive material 11A is supported at the proximal end of the cap by the reinforcement band 23 of the cap, and is affixed to a soft material 25 on the outer surface of a cap that is worn on a finger or the big toe, and the strip of the piezoresistive material 24 expands in the directions 51A given by two arrows as a force is applied to its surface.

Figure 12:
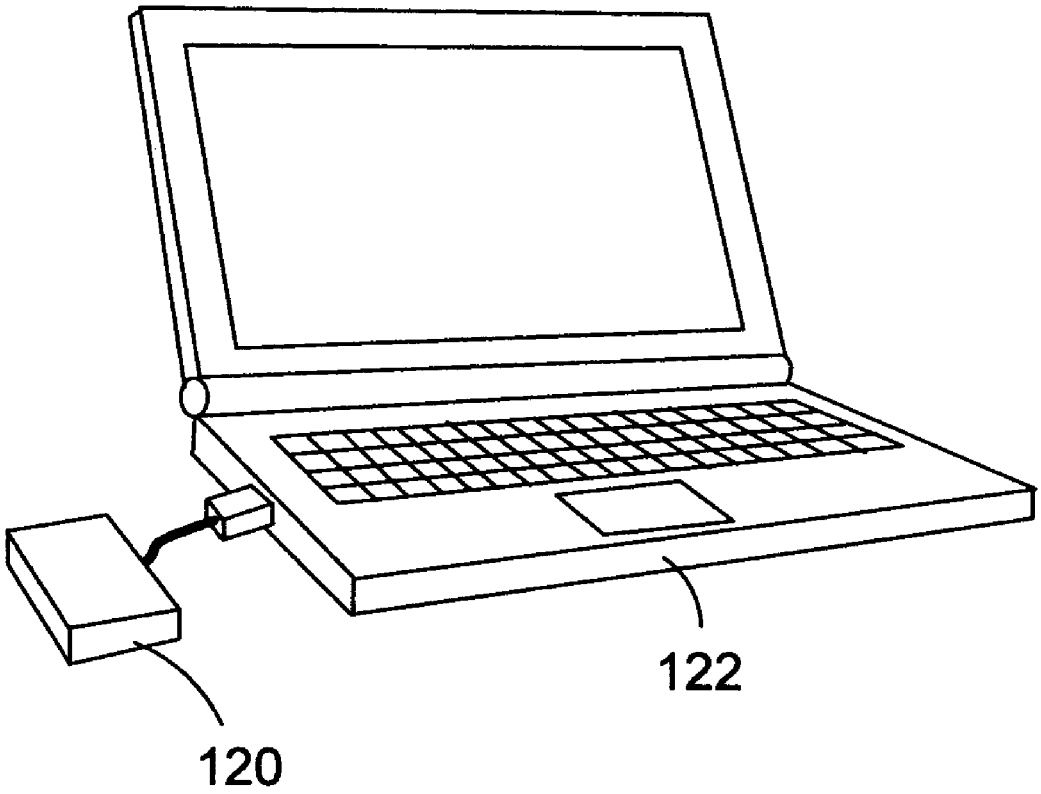
FIG. 12 is a contactless radio frequency interface device that is used to transfer data between the hand, foot and wrist units and a computer.

The swim device includes an interface 120 to a PC or equivalent 122 that is used in contactless data transmission between the computer and the three wearable units, and a computer software to analyze the pressure sensor data generated by the hand and foot sensor units; i.e., the hand sensor unit, the foot sensor unit, and the wrist unit system (see FIG. 12). The internal clock of the computer is synchronized via the Internet through the NIST Internet Time Service (ITS) in the United States.

The computer 122 is used to synchronize the internal clocks of the three wearable units with the internal clock of the computer; to input selected data such as user name and password to the wearable units; to analyze pressure data; and to use as a surrogate of a wrist unit for an individual swimmer or a base unit for a plurality of swimmers each using at least one hand sensor unit and one foot sensor unit. The base unit functions like a wrist unit for a plurality of swimmers: it synchronizes clocks as discussed above, creates whistle-like sounds at the start (the computer must be equipped with a speaker), receives on/off data or pressure data of a plurality of swimmers, clocks the starting time, computes the swim results of all the participating swimmers, and analyzes their swim.

Figure 13A:
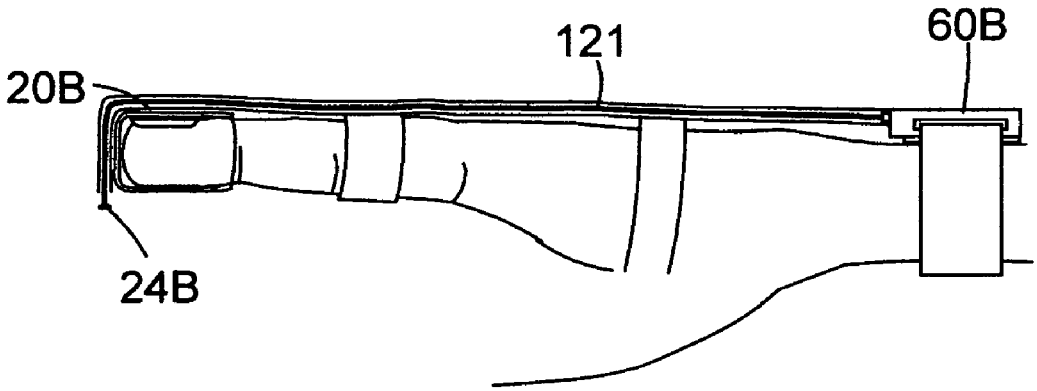
FIG. 13A is a part cross-sectional view and a part perspective view of an alternative embodiment of the wrist unit system with a push-button type sensor, and FIG. 13B the foot sensor unit and a lap counter held by a band strapped around the ankle.
Figure 13B:
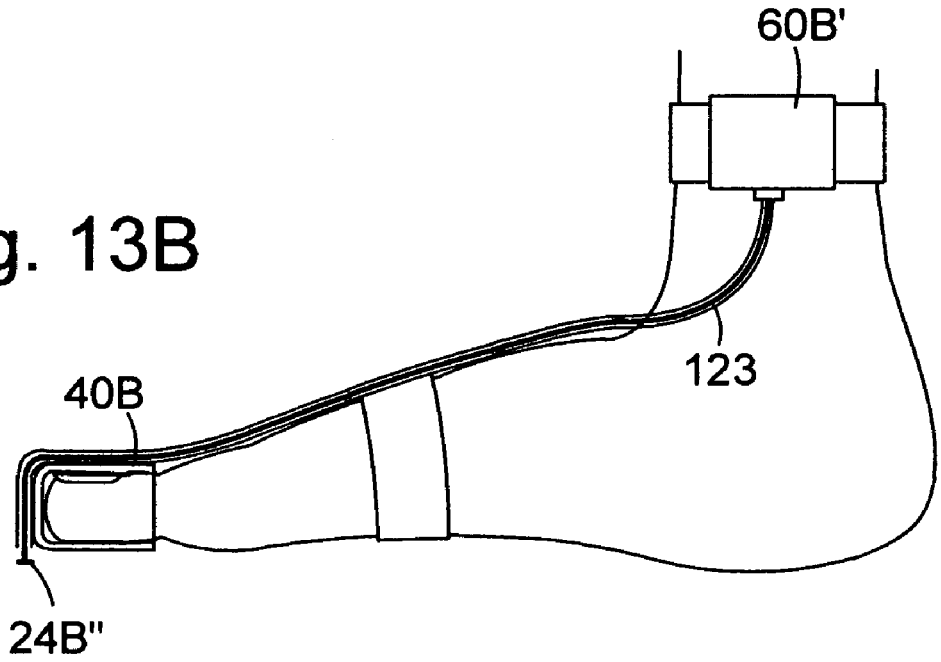

Another alternative embodiment of the swim device comprises a chronograph 60B (or equivalent), a mechanically activated push button 20B and a coil shaped wire 121 enclosed in a tube that connects the push button and the chronograph that is equipped with an alarm that makes sounds of a whistle (see FIG. 13A), and an electronic lap counter 60B', a mechanically activated foot touch sensor unit 40B and a coil-shaped wire enclosed in a tube that connects the push button and the lap counter (see FIG. 12B). The chronograph is a special form of the wrist unit with reduced functionalities. As shown in FIG. 13A, the chronograph 60B is strapped around the wrist, and the push button 24B' which is a special form of a pressure sensor, is worn on the first finger segment of a finger, or attached to a band that straps around the first segment of the finger. The chronograph is able to record the elapsed time between the first time and the last time the touch sensor is pressed. The foot sensor unit 40B has a push button 24B" that is affixed to a big toe cap or attached to a band that straps around the big toe, and the lap counter 60B' that is strapped around the ankle. The swimmer will press a button that will make two separate sounds of whistle with a predefined interval at the start for ready and start signals. The chronograph will measure the elapsed time between the second whistle and the hand sensor unit's touch detection time at the finish. Regarding the lap counter, whenever the touch sensor button of the foot sensor unit is pressed, the reading of the counter increases by 0.5 wherein the reading is −0.5 before starting the swim.

Figure 14:
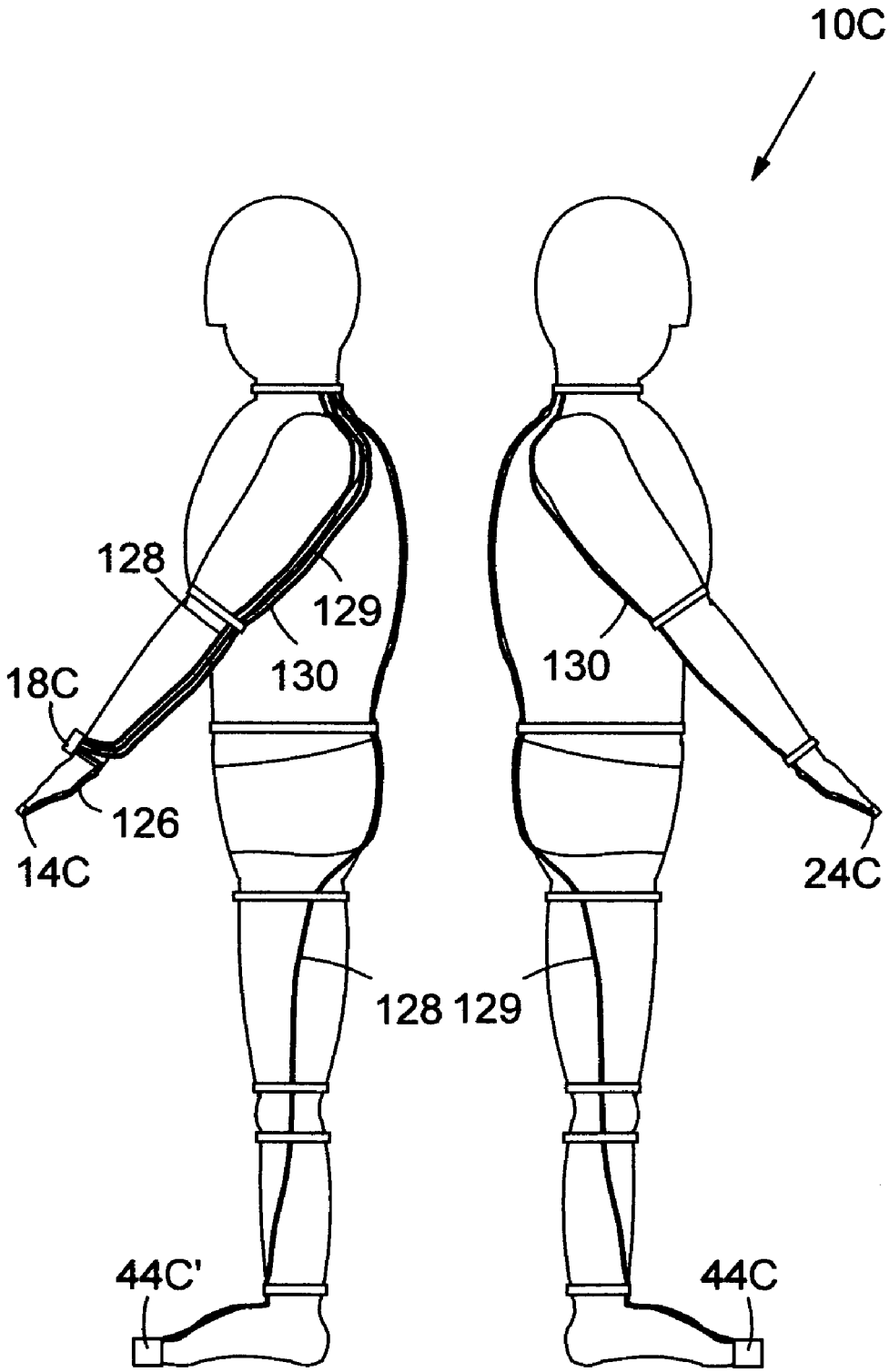
FIG. 14 is another alternative embodiment in which the sensors attached to the caps that are worn on the finger tips of the right and left hands and the toes of the right and left feet and connected to the wrist unit by wires.

As shown in FIG. 14, another alternative embodiment 10C includes a wrist unit 18C, which is generally identical to that included in the wrist unit system 60 of the preferred embodiment except that to which wrist unit as many as four pressure sensors may be connected. Two of the pressure sensors 14C and 24C are worn on hands, and the other two pressure sensors 44C and 44C' are worn on feet. The pressure sensors 14C, 24C, 44C, and 44C' are connected to the wrist unit 18C by wires 126, 130, 129, and 128, respectively wherein the wires are held by a plurality of elastic bands 133 at key locations of the swimmer's body.

Alternative Embodiment 10D includes the wrist unit system (60 or 60A) with the pressure sensor or sensors that is able to make whistle-like sounds in the last lap or last 24, length of the swim.

Alternative Embodiment 10E comprises a computer 122A equipped with necessary software and the interface, at least one hand sensor unit, and at least one foot sensor unit. In this alternative, the computer 122A is a surrogate of the wrist unit 18 in the preferred embodiment, and thus the software included in the computer 122A must include the functionality in the software in the wrist unit 18.

Another alternative embodiment includes a wrist unit that vibrates instead of making sounds while in the last lap or length.

The invention having been described in detail in accordance with the requirements of the U.S. Patent Statutes, various other changes and modifications will suggest themselves to those skilled in this art. It is intended that such changes and modifications shall fall within the spirit and scope of the invention defined in the appended claims.

I claim:

1. A wearable swim device that is worn by a swimmer and that measures elapsed time and count number of laps in a swim including at least a wrist unit system wherein said wrist unit system includes a wrist unit worn on a wrist, said wrist unit system includes at least one pressure sensor, said pressure sensor is attached to a cap or equivalent worn on first segment of a finger of a hand on same side of a body as said wrist unit is worn, said pressure sensor is connected to said wrist unit by at least one wire, said pressure sensor is a touch pressure sensor that is able to detect said swimmer's hand stroking water during said swim.

2. A wearable swim device that is worn by a swimmer and that measures elapsed time and count number of laps in a swim including at least a wrist unit system wherein said wrist unit system includes a wrist unit worn on a wrist, said wrist unit system includes at least one pressure sensor, said pressure sensor is attached to a cap or equivalent worn on first segment of a finger of a hand on same side of a body as said wrist unit is worn, said pressure sensor is connected to said wrist unit by at least one wire, said wrist unit system includes two pressure sensors wherein said pressure sensors are touch pressure sensors, one of said pressure sensors detects swimmer's hand touching a swimming pool wall but does not detect swimmer's hand stroking water, and the other one of said touch pressure sensors detects swimmer's hand touching a swimming pool wall and swimmer's hand stroking said water while said swimmer swims.

3. A wearable swim device that is worn by a swimmer and that measures elapsed time and count number of laps in a swim including at least a wrist unit system wherein said wrist unit system includes a wrist unit worn on a wrist, said wrist unit system includes at least one pressure sensor, said pressure sensor is attached to a cap or equivalent worn on first segment of a firmer of a hand on same side of a body as said wrist unit is worn, said pressure sensor is connected to said wrist unit by at least one wire, said swim device includes a pressure sensor that is attached to a cap or equivalent and worn on first finger of a hand on the other side of body as said wrist unit, and said pressure sensor is connected to said wrist unit at least by one wire.

4. A wearable swim device that is worn by a swimmer and that measures elapsed time and count number of laps in a swim including at least a wrist unit system wherein said wrist unit system includes a wrist unit worn on a wrist, said wrist unit system includes at least one pressure sensor, said pressure sensor is attached to a cap or equivalent worn on first segment of a finger of a hand on same side of a body as said wrist unit is worn, said pressure sensor is connected to said wrist unit by at least one wire, said swim device includes at least one pressure sensor that is attached to a cap or equivalent and worn on a big toe, and said pressure sensor is connected to said wrist unit at least by one wire.

* * * * *